US006478756B1

(12) United States Patent
Chen

(10) Patent No.: US 6,478,756 B1
(45) Date of Patent: Nov. 12, 2002

(54) DEVICE FOR CLEANING AND MASSAGING A FOOT

(75) Inventor: Ching-Hsi Chen, Changhwa (TW)

(73) Assignee: Chyau Feng Plastics Industrial Co., Ltd., Changhwa (TW)

( * ) Notice: Subject to any disclaimer, the term of this patent is extended or adjusted under 35 U.S.C. 154(b) by 0 days.

(21) Appl. No.: 09/903,909

(22) Filed: Jul. 13, 2001

(51) Int. Cl.[7] ..... A61H 19/00

(52) U.S. Cl. ..... 601/134; 601/136; 601/28; 601/138

(58) Field of Search ..... 601/134, 135, 601/136, 137, 138, 27, 28

(56) References Cited

U.S. PATENT DOCUMENTS 3,636,946 A * 1/1972 Hardy ..... 482/123
4,003,372 A * 1/1977 Willoby ..... 15/110
5,072,480 A * 12/1991 Peters et al. ..... 15/114
5,577,997 A * 11/1996 Thariani et al. ..... 601/135
6,171,269 B1 * 1/2001 Norin ..... 132/75.6
6,293,916 B1 * 9/2001 Alviso ..... 601/134

* cited by examiner

*Primary Examiner*—Michael A. Brown
*Assistant Examiner*—Benjamin K. Koo
(74) *Attorney, Agent, or Firm*—Harrison & Egbert

(57) ABSTRACT

A device to clean and rub the foot includes a main body and an auxiliary massage member. The main body is provided in the underside with a plurality of suction cups, and in the upper side with a cleaning area for cleaning the foot, a rubbing area for massaging the foot, and a receiving slot for retaining the auxiliary massage member different from the rubbing area in the massaging effect.

4 Claims, 8 Drawing Sheets

DEVICE FOR CLEANING AND MASSAGING A FOOT

BACKGROUND OF THE INVENTION

1. Field of the Invention

The present invention relates generally to a foot sole cleaning device, and more particularly to a foot sole cleaning device which is provided with means to massage the sole of a foot.

2. Description of Related Art

Most people find it troublesome to clean the soles of their feet while taking a bath in bathtub or shower, especially at such time when they stand on a slippery surface of the bathtub with one foot to facilitate the cleaning of the other foot. Once they lose their footing, they are apt to fall and incur an injury.

BRIEF SUMMARY OF THE INVENTION

It is a primary objective of the present invention to provide a foot sole washing device to facilitate the cleaning of the foot soles of a bath-taker.

It is another objective of the present invention to provide a foot sole cleaning device with means to rub the foot sole of a bath-taker while the foot sole is being washed.

In keeping with the principle of the present invention, the foregoing objectives of the present invention are attained by a device comprising a main body and an auxiliary massage member. The main body is provided in the underside with a plurality of suction cups, and in the upper side with a cleaning area, a massaging area opposite in location to the cleaning area, and a receiving slot located between the cleaning area and the massaging area. The auxiliary massage member is secured in place in the receiving slot of the main body.

The objectives, features, and functions of the device of the present invention will be more readily understood upon a thoughtful deliberation of the following detailed description of the present invention with reference to the accompanying drawings.

DETAILED DESCRIPTION OF THE INVENTION

Figure 1:
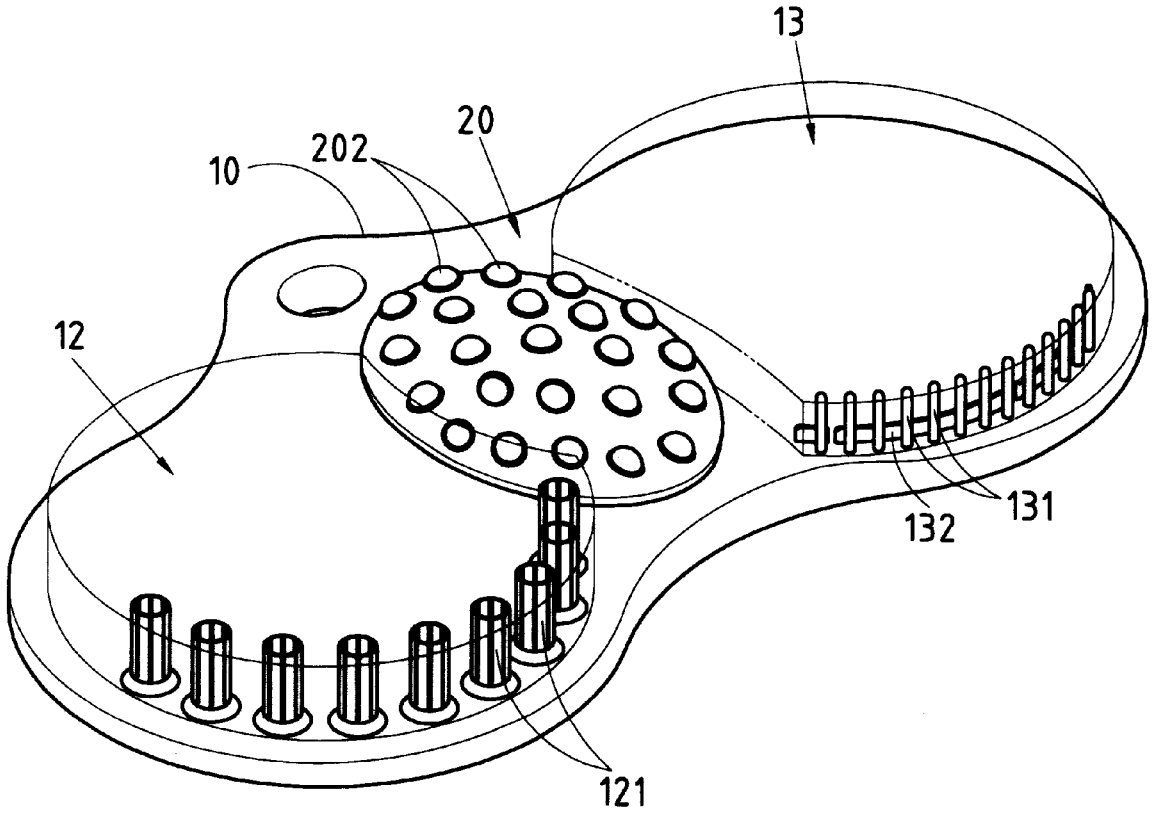
FIG. 1 shows a perspective view of the present invention.

As shown in FIGS. 1–5, a device embodied in the present invention comprises a main body 10 and an auxiliary massage member 20.

The main body 10 is provided in the underside with a plurality of suction cups 11 for locating securely the main body 10 on a slippery surface of the bathroom or bathtub. The main body 10 is further provided in the upper side with a cleaning area 12, a rubbing area 13, and a receiving slot 14 located between the cleaning area 12 and the rubbing area 13. The cleaning area 12 is provided with a number of bristles 121 for cleaning the foot sole. The rubbing area 13 is provided with a plurality of upright pillars 131 which are arranged in rows. The rubbing area 13 is further provided with a plurality of ribs 132 which are arranged between two rows of the pillars 131 and are smaller in height than the pillars 131.

The auxiliary massage member 20 is provided in the upper side with a corrugated surface having a massaging effect. The auxiliary massage member 20 is secured in place in the receiving slot 14 of the main body 10.

Figure 2:
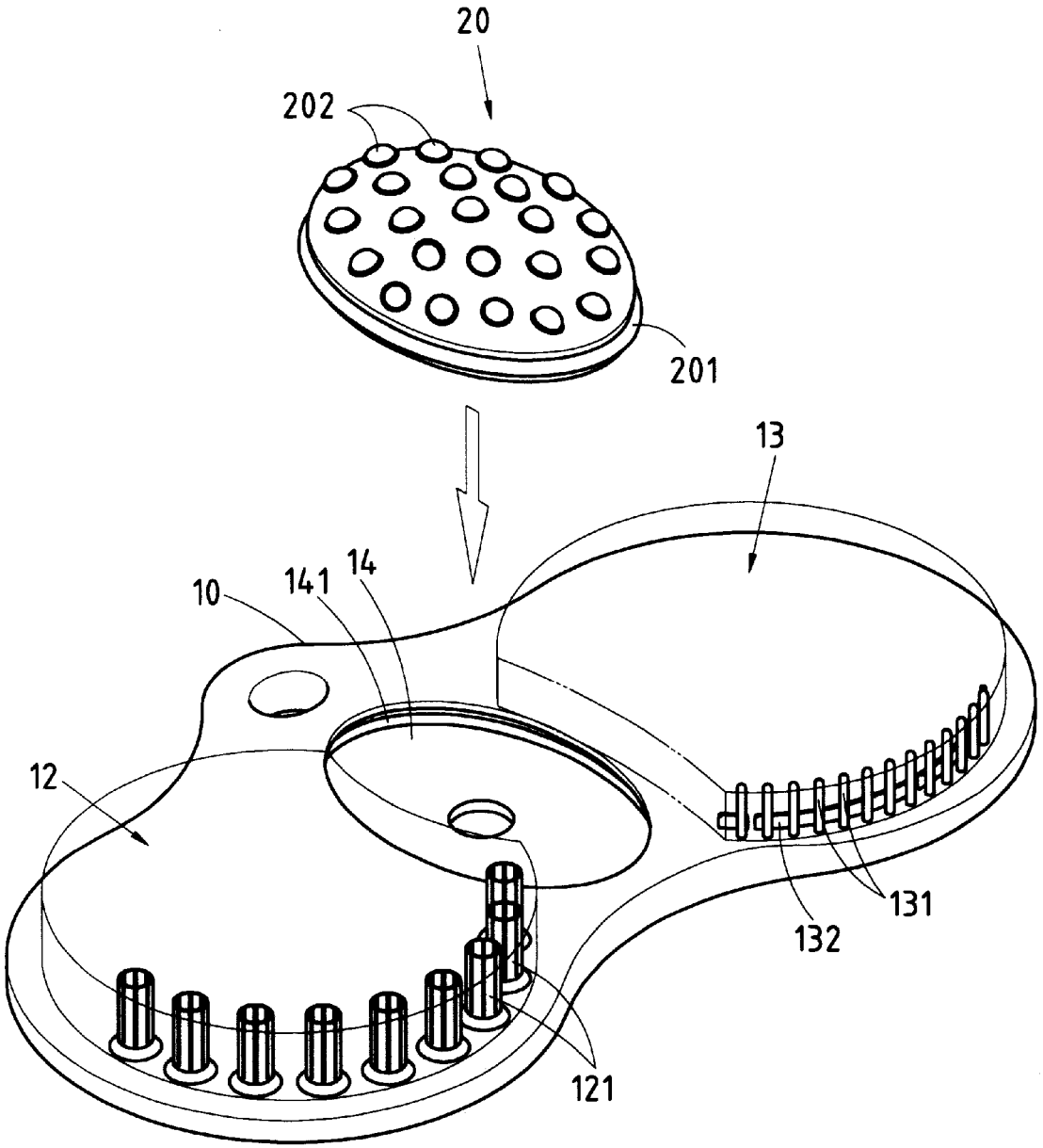
FIG. 2 shows an exploded view of the present invention.
Figure 3:
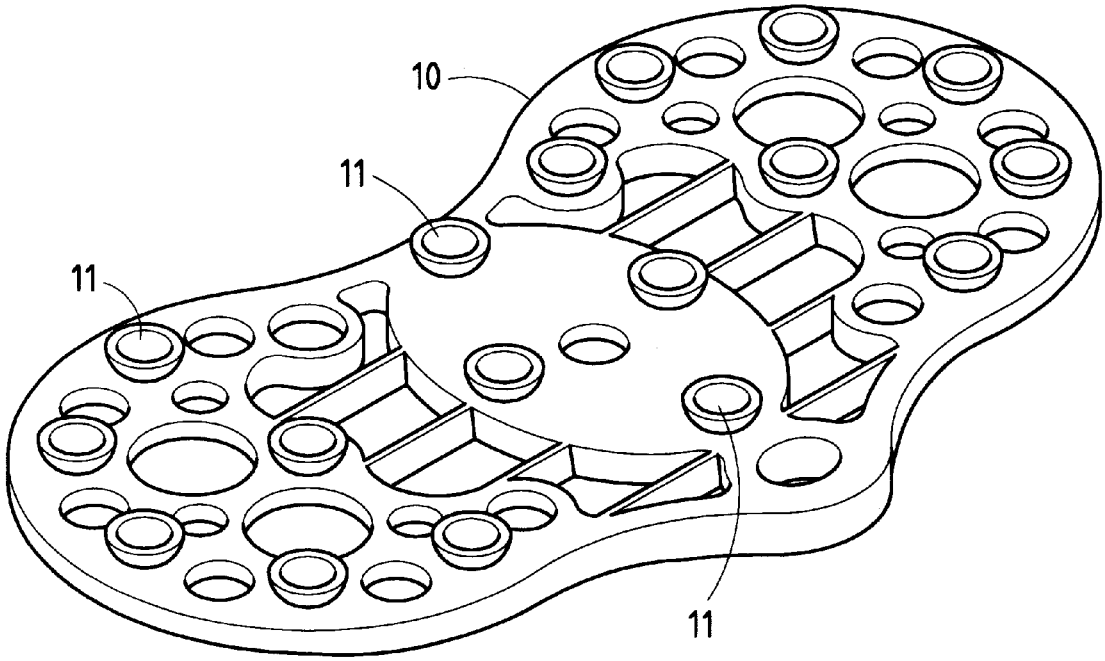
FIG. 3 shows a schematic view of the underside of the main body of the present invention.
Figure 5:
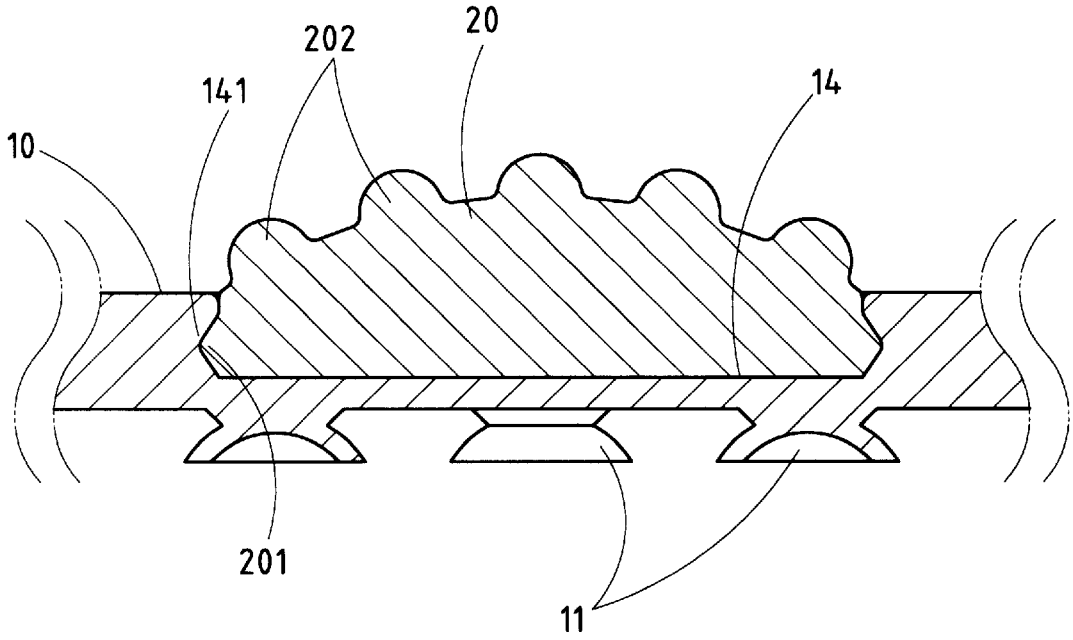
FIG. 5 shows a partial sectional view of the present invention.

As shown in FIGS. 2 and 5, the receiving slot 14 of the main body 10 is provided with an annular recess 141 extending along the inner wall of the receiving slot 14. The auxiliary massage member 20 is provided with an annular projection 201 extending along the outer wall of the auxiliary massage member 20. The auxiliary massage member 20 is securely retained in the receiving slot 14 of the main body 10 such that the annular projection 201 of the auxiliary massage member 20 is retained in the annular recess 141 of the receiving slot 14 of the main body 10, as shown in FIG. 5.

Figure 4:
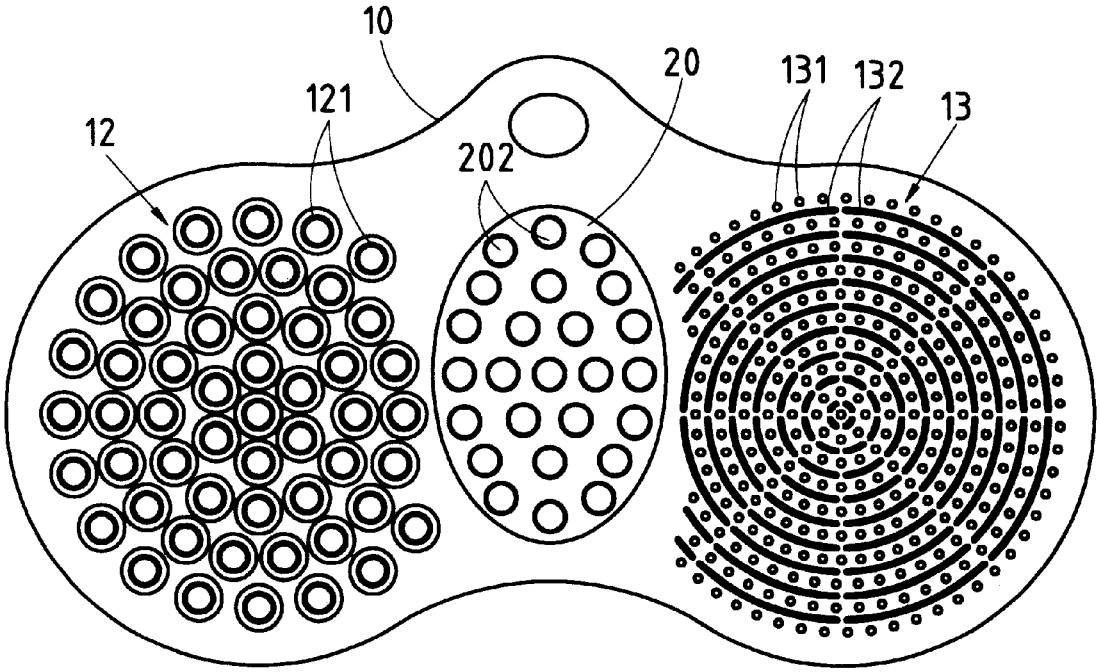
FIG. 4 shows a top plan view of the upper side of the present invention.

As shown in FIGS. 1, 4 and 5, the auxiliary massage member 20 is provided in the upper side with a plurality of knobs 202 having a massaging effect.

Figure 6:
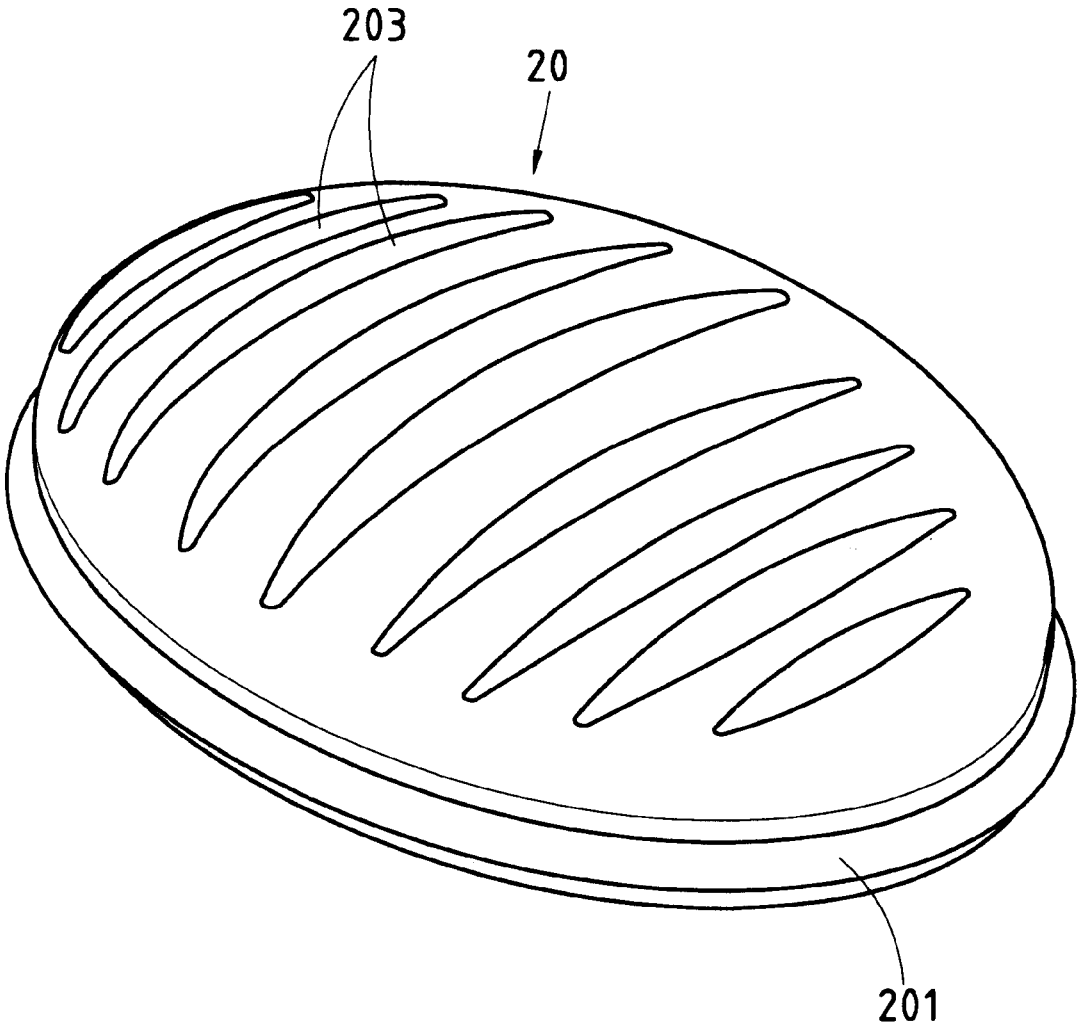
FIG. 6 shows a schematic view of an auxiliary massage member of another preferred embodiment of the present invention.
Figure 7:
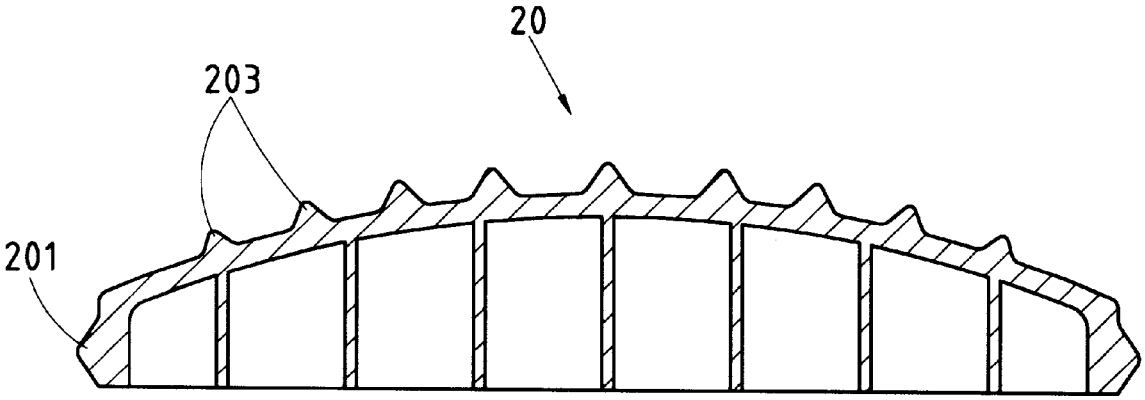
FIG. 7 shows a sectional view of the auxiliary massage member of the present invention as shown in FIG. 6.

As shown in FIGS. 6 and 7, the upper side of the auxiliary massage member 20 is modified in such a way that the upper side is provided with a plurality of ridges 203, with each having a tapered cross section, as shown in FIG. 7.

Figure 8:
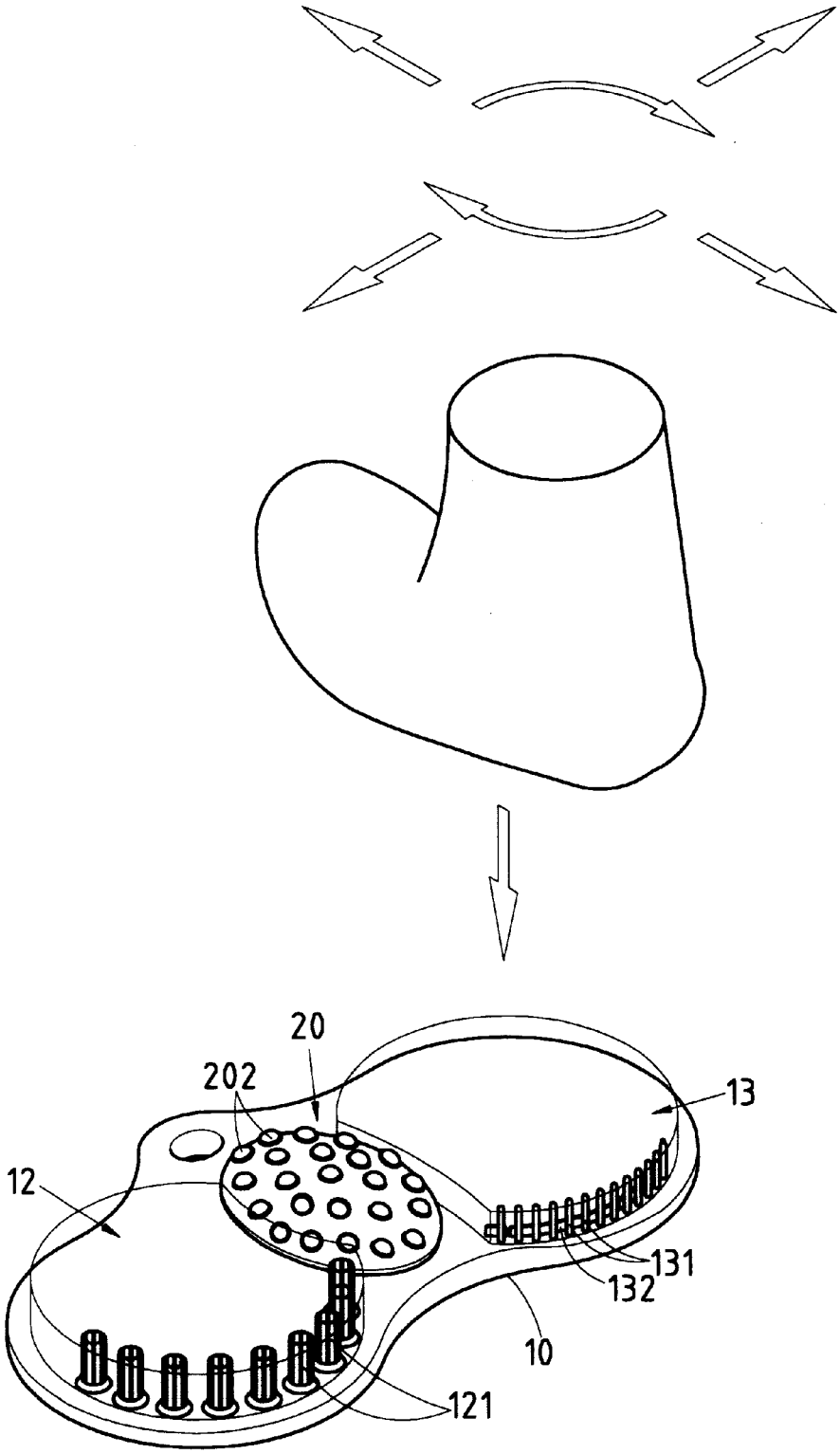
FIG. 8 shows a schematic view of the present invention at work.

As illustrated in FIG. 8, a foot sole is cleaned and rubbed at the same time by the device of the present invention. The cleaning of the foot sole is done by the bristles 121 of the cleaning area 12 of the main body 10. The massaging of the foot sole is attained by the pillars 131 and the ribs 132 of the rubbing area 13, as well as the auxiliary massage member 20. The knobs 202 and the ridges 203 of the auxiliary massage member 20 serve to provide a relatively gentle massaging sensation. The pillars 131 and the ribs 132 of the rubbing area 13 serve to provide a relatively acute massaging sensation.

The present invention described above is to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A device for cleaning and massaging a foot sole comprising:

a main body having a plurality of suction cups on an underside thereof, said main body having a cleaning area and a rubbing area on an upper side thereof, said main body having a receiving slot formed between said cleaning area and said rubbing area, said cleaning area having a plurality of bristles extending upwardly therefrom, said rubbing area having a plurality of pillars extending upwardly therefrom, said plurality of pillars being arranged in spaced apart rows, said rubbing area having a plurality of ribs of a height less than a height of said plurality of pillars, each of said plurality of ribs arranged between adjacent pairs of said spaced apart rows; and an auxiliary massage member having a corrugated surface on an upper surface thereof, said auxiliary massage member being retained in said receiving slot of said main body.

2. The device of claim 1, said receiving slot having an annular recess extending along an inner wall thereof, said auxiliary massage member having an annular projection extending along an outer wall thereof, said auxiliary massage member being retained in said receiving slot such that said annular projection is retained in said annular recess of said receiving slot.

3. The device of claim 1, said corrugated surface of said auxiliary massage member being a plurality of knobs.

4. The device of claim 1, said corrugated surface of said auxiliary massage member being a plurality of ridges, each of said plurality of edges having a tapered cross section.

* * * * *